United States Patent [19]

Spencer et al.

[11] 4,431,058

[45] Feb. 14, 1984

[54] WASH TOOL METHOD FOR SUBTERRANEAN WELLS

[75] Inventors: Jack D. Spencer, Long Beach, Calif.; John V. Salerni, Kingwood, Tex.

[73] Assignee: Baker International Corporation, Orange, Calif.

[21] Appl. No.: 243,234

[22] Filed: Mar. 16, 1981

[51] Int. Cl.[3] ..... E21B 37/00

[52] U.S. Cl. ..... 166/312; 166/386; 166/184; 166/191; 166/332

[58] Field of Search ..... 166/311, 312, 222, 185, 166/184, 191, 332, 334, 373, 386, 146, 147, 150

[56] References Cited

U.S. PATENT DOCUMENTS

| | | | |
|---|---|---|---|
| 2,512,801 | 6/1950 | Kinney et al. | 166/185 |
| 2,649,916 | 8/1953 | Brown | 166/150 |
| 2,681,705 | 6/1954 | Tappmeyer | 166/150 |
| 3,412,805 | 11/1968 | Gribben et al. | 166/147 |
| 3,456,724 | 7/1969 | Brown | 166/146 |
| 4,027,732 | 6/1977 | Perkins | 166/312 |
| 4,279,306 | 7/1981 | Weitz | 166/312 |
| 4,280,561 | 7/1981 | Fredd | 166/332 |

*Primary Examiner*—Stephen J. Novosad
*Assistant Examiner*—William P. Neuder
*Attorney, Agent, or Firm*—Norvell & Associates

[57] ABSTRACT

The disclosure relates to an improved tool and method for effecting the washing of sand or particulates from casing perforations and channels in production formations in subterranean wells. The tool employed comprises an outer body suspended from a first tubing string and having vertically spaced seals in engagement with the casing wall above and below the set of casing perforations to be washed. Radial wash ports are provided in the outer body between the annular seals. An inner body, carried by a second tubing string is inserted within the first tubing string and outer body and effects a sealing engagement with the bore of the outer body at a location below the radial wash ports. Washing fluid is then introduced into the well through the annulus defined between the first and second tubing strings and the sand laden washing fluid is returned to the well surface through the bore of the inner body and the connected second tubing string.

3 Claims, 4 Drawing Figures

WASH TOOL METHOD FOR SUBTERRANEAN WELLS

BACKGROUND OF THE INVENTION

1. FIELD OF THE INVENTION:

This invention relates to an improved tool for effecting the washing of sand or particulates from casing perforations and channels in formations in subterranean wells.

2. HISTORY OF THE PRIOR ART:

Most producing subterranean oil wells are plagued with sand accumulating in the channels or flow passages in the producing formation and the casing perforations through which the production fluid must flow. It has been the common practice to reduce the accumulation of such sand by establishing a reverse flow of a washing fluid through the casing perforations and into the channels of the production formation, and then retrieving the sand laden washing fluid from the well. The removed sand is then replaced by gravel.

Washing tools heretofore employed conducted the washing fluid downwardly to the vicinity of the production formation through a tubing string, disposed within the casing, to a tubular body wash tool having sealing engagement with the casing wall both above and below the casing perforations. A relatively high pressure, high volume fluid was then introduced through the central tubing string and permitted to discharge through the casing perforations and into the channels of the production formation, carrying with it any sand disposed in its path. Sand laden fluid then flowed downwardly through the apertures normally existing between the exterior of the casing wall and the well bore and entered the bottom of the casing to flow upwardly. A crossover passage was provided in the bottom end of the wash tool to direct the sand laden, upwardly flowing fluid around the portion of the wash tool supplying the washing fluid and thence into the casing annulus for removal from the well.

This particular arrangement was obviously complicated and expensive in requiring a crossover configuration to be incorporated in the wash tool. More importantly, the upward flow path for the sand laden washing fluid was of sufficiently large area that it was difficult to maintain sufficient upward fluid velocity to insure that all of the loosened sand would be carried to the surface, particularly in deviated wells.

SUMMARY OF THE INVENTION

This invention provides an improved method and apparatus for effecting the washing of perforations and channels of a subterranean well. An outer tubular body carried by a tubing string is first introduced into the well and defines a plurality of radial wash ports which are respectively disposed axially intermediate annular sealing elements. Such sealing elements are engagable with the casing wall and normally positioned above and below a limited number of perforations in the casing wall. To permit the unimpeded passage of the annular sealing elements downwardly through the casing without creating a vacuum behind such sealing elements, a plurality of bypass ports are provided in the outer tubular body at a position above the sealing elements and normally maintained in an open position by an axially shiftable valve. Such valve has an upper set of collets that normally retain the valve in an open position with respect to the radial bypass ports, and a lower set of collets which maintain the valve in a closed position relative to the radial ports when such lower collet elements are engaged and moved downwardly by the insertion of an inner tubular body element within the outer tubular body, such inner element seating in sealing relationship upon an upwardly facing shoulder in the tubular body located at a position below the radial wash ports in such outer tubular body.

Washing is then accomplished by passing a conventional washing fluid downwardly through the relatively large annulus defined between the inner and outer tubular body elements of the washing tool, which fluid passes outwardly through the radially disposed washing ports in the outer tubular body and through the casing perforations to effect a washing action on the perforations and oil production formation channels in fluid communication with such perforations. The sand laden washing fluid then circulates downwardly around the bottom end of the casing, enters the bottom end of the outer tubular body and then flows in unimpeded fashion into the bottom end of the inner tubular body. The flow passage area of the inner tubular body is substantially smaller than that of the annulus between the outer and inner tubular bodies so that a higher fluid flow rate is maintained for the upwardly flowing, sand carrying washing fluid which passes to the wellhead through the inner tubular body.

On completion of the washing operation, the elevation of the inner tubular body relative to the outer tubular body will effect an engagement of a locator sub carried at the bottom of the inner tubular body with the upper set of collets secured to the valve sleeve and will return the valve to its open position with respect to the radial bypass ports provided in the outer tubular body. will be readily apparent to those skilled in the art from the following detailed description, taken in conjunction with the annexed sheets of drawings, on which is shown a preferred embodiment of the invention.

BRIEF DESCRIPTION OF DRAWINGS

FIGS. 1B and 1C respectively being vertical continuations of FIGS. 1A and 1B.

DESCRIPTION OF PREFERRED EMBODIMENTS

Figure 1A:
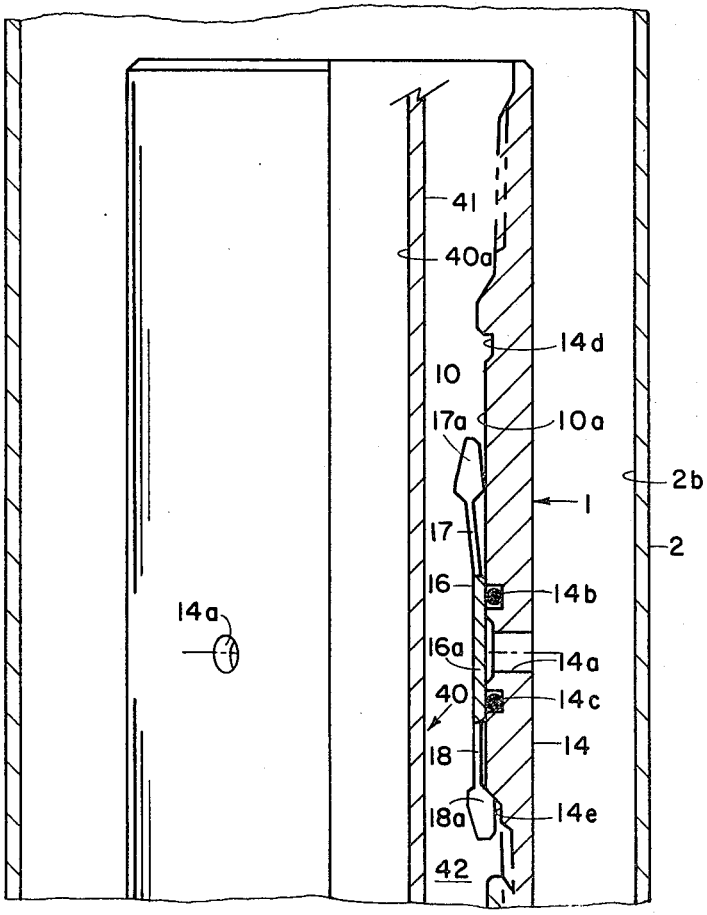
FIGS. 1A–1C collectively constitute a vertical sectional view of a washing tool embodying this invention, shown in operative position within the casing of a subterranean well.
Figure 1B:
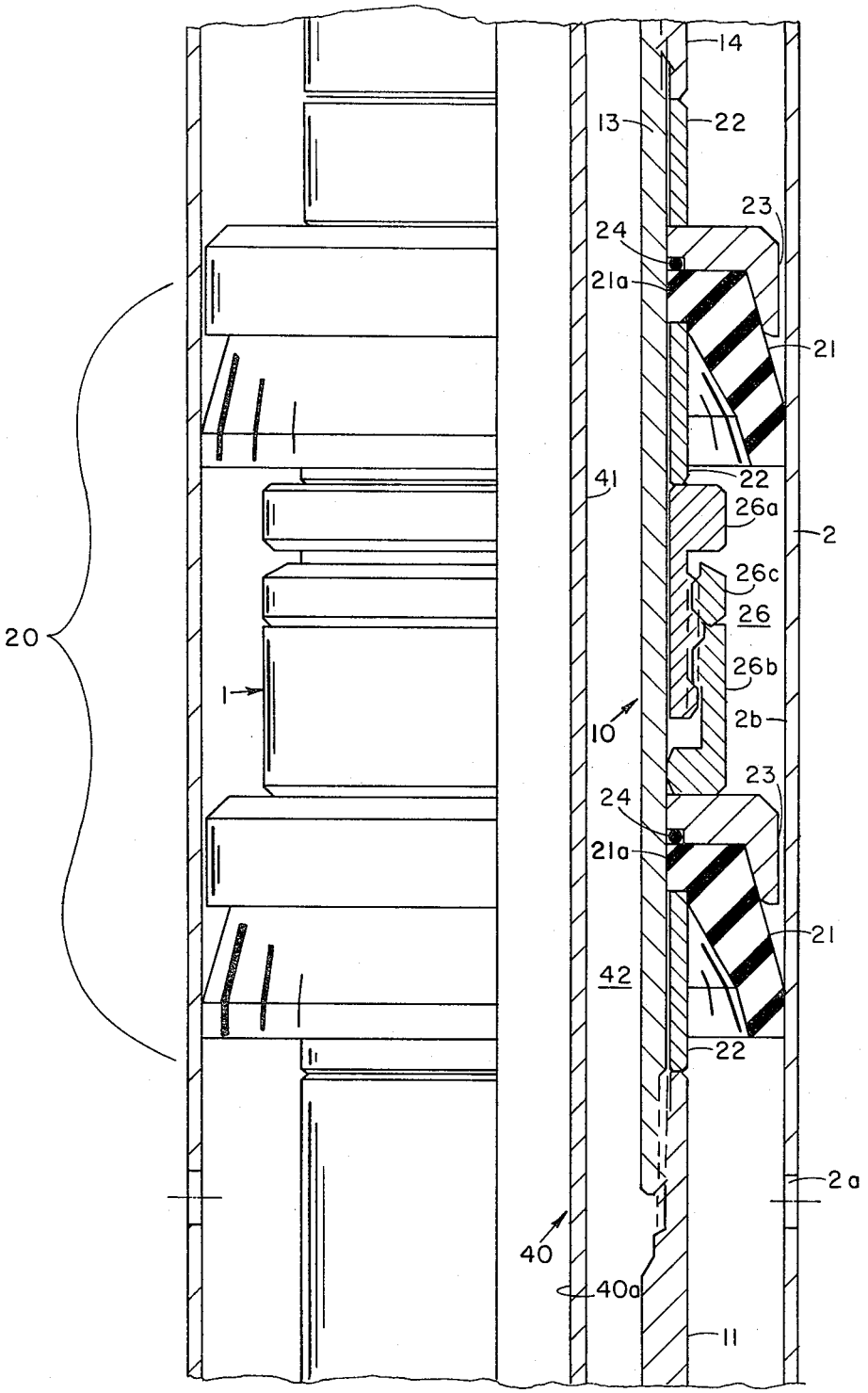
Figure 1C:
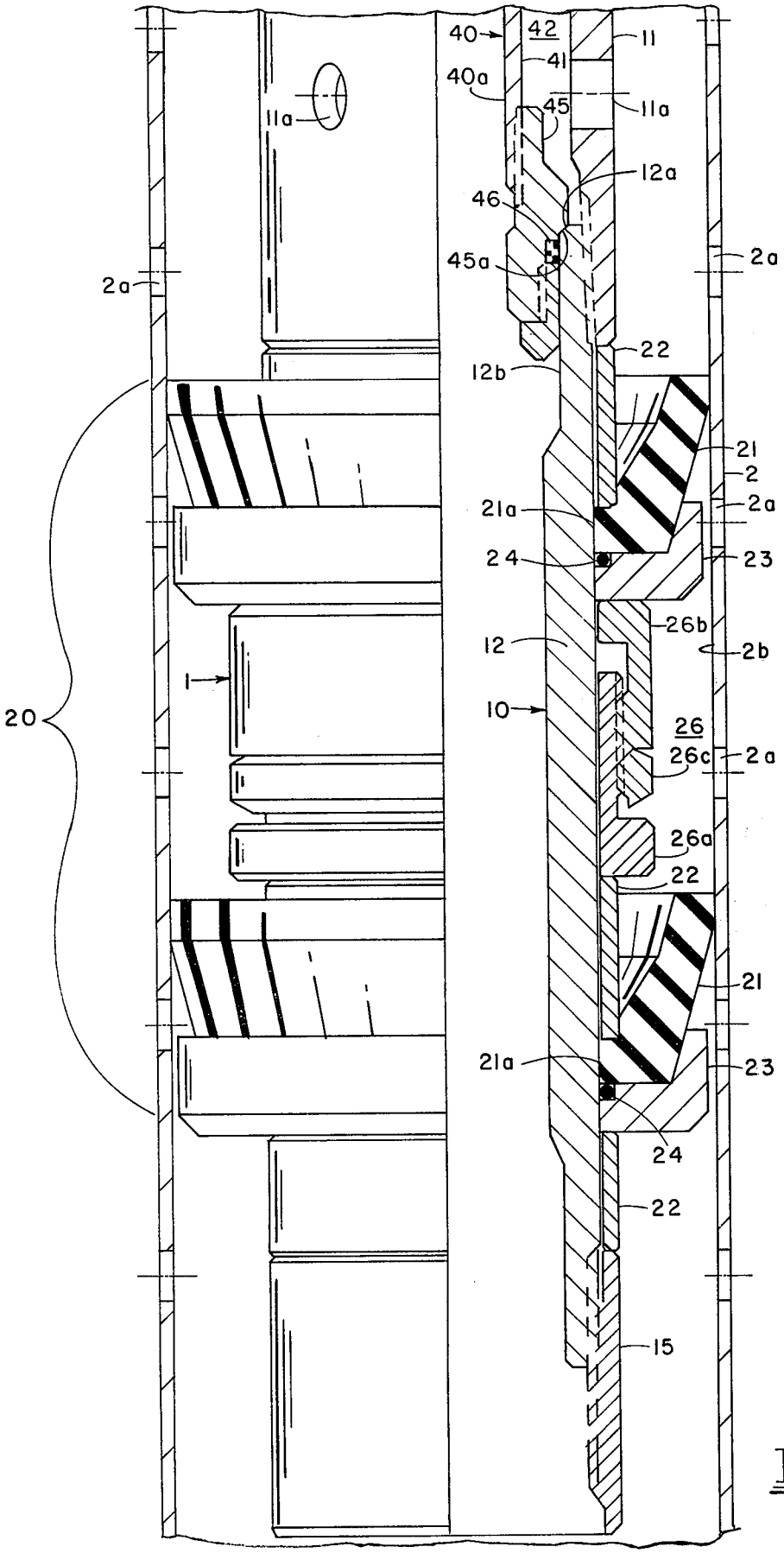

Referring particularly to FIGS. 1A–1C, there is shown a wash tool 1 embodying this invention, disposed in operative relationship to a casing 2 having perforations 2*a* formed therein. Although not shown, those skilled in the art will understand that in the normal operation of a producing well, a production formation will have a number of channels or passages communicating with the perforations 2*a*. Also, the particular well may have a plurality of vertically spaced sets of perforations 2*a* so that the washing operation may be conducted successively at each set, generally beginning at either the top set of perforations and successively working downwardly, or alternatively, at the lowermost set of perforations and successively working upwardly.

Tool 1 comprises an outer tubular body assembly 10, having a plurality of radial ports 11*a* formed therein, which are normally disposed opposite or in the vicinity of the set of casing perforations 2*a* which are desired to be washed. The tubular body 10 is defined by two axially elongated sleeve portions 12 and 13, which are respectively threadedly interconnected by an internally threaded connection sleeve 11, and by a valve sleeve 14 threadedly connected to the top end of a sleeve 13. Sleeve 14 is in turn connected to a tubing string (not shown).

To isolate the washing fluid flow coming through the ports 11*a*, two sets of annular sealing elements 20 are provided on outer body assembly 10, with each set being respectively positioned above and below the radially disposed washing ports 11*a*. The annular sealing elements 20 are substantially identical and respectively mounted on sleeves 12 and 13 and hence only one set will be described. The upper annular sealing element 20 is clamped between valve sleeve 14 and the upper end of the connecting sleeve 11, while the lower annular sealing element 20 is clamped between the lower end of connecting sleeve 11 and the upper end of an internally threaded sleeve 15, which is threadedly secured to the lower end of the bottom sleeve 12.

Two annular elastomeric sealing elements 21, of identical configuration, are clamped between the aforementioned shoulders. The elastomeric sealing elements 21 are of a generally cup-shaped configuration and the internal peripheral portion 21*a* of each annular sealing element 21 is clamped between a spacing sleeve 22 and a packer cup 23. An O-ring seal 24 is provided on the internal periphery of the packer cup 23 to prevent leakage through the inner periphery of the cup-shaped annular sealing element 21.

An axial clamping force is exerted by an expansion device 26 which comprises an externally threaded sleeve 26*a* which threadedly cooperates with an internally threaded sleeve 26*b*. Relative rotation of the sleeves 26*a* and 26*b* produces an expansion of the elements of the assembly 26 and exerts a clamping force on the packer cup 23 and the spacer sleeve 22 between which the expansion assembly is disposed. An internally threaded lock ring 26*c* is provided to lock the expansion assemblage 26 in its expanded clamping position.

Figure 2:
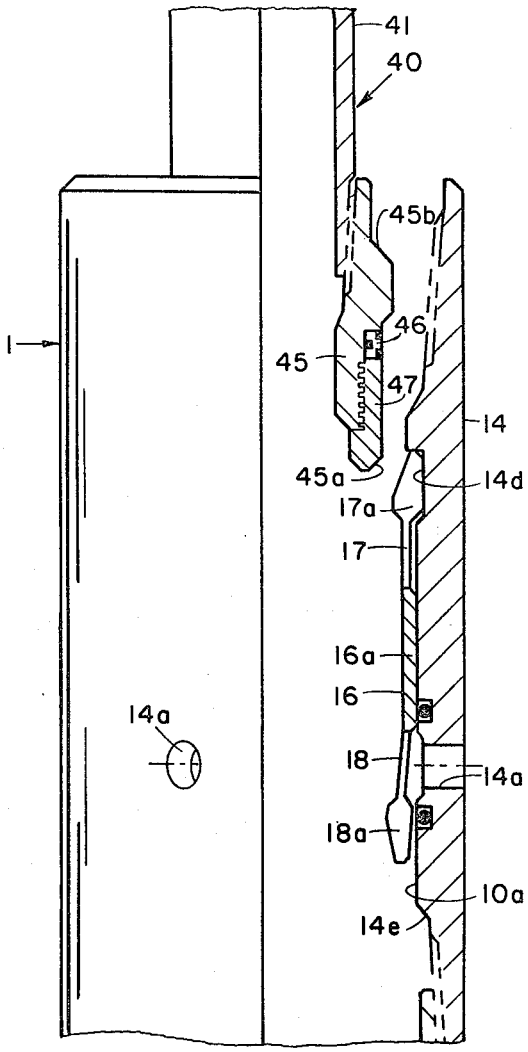
FIG. 2 is a partial vertical sectional view of the wash tool of FIGS. 1A through 1C, showing the position of the annulus bypass valve during the running of the tool into the well casing.

The maximum external diameter of the annular elastomeric sealing elements 21 is in excess of the internal diameter of the casing bore 2*b* so that such elastomeric elements achieve a good sealing relationship with the casing bore. As is well known to those skilled in the art, when it is attempted to insert the tubular outer body assembly 10 downwardly through the casing 2 to a position opposite the casing perforations 2*a*, the elastomeric elements would tend to produce a vacuum behind them which would seriously interfere with their introduction into the well casing. For this reason, the valve sleeve 14 is provided with a plurality of radially disposed bypass ports 14*a* which, in the run-in position of the outer tubular body 10, are open and permit free communication between the casing annulus and the interior of the outer tubular body 10 and its connected tubing string (not shown). However, when the washing operation is to be performed, the bypass ports 14*a* must be closed and this is accomplished by sliding an axially shiftable valve 16 from the run-in position shown in FIG. 2 to the wash position shown in FIG. 1A. Valve 16 includes a solid annular central portion 16*a* which is of sufficient axial extent to sealingly cooperate with O-rings 14*b* and 14*c* respectively provided in the valve sleeve 14 immediately above and below the bypass ports 14*a*. Valve 16 has a set of peripherally spaced upper collet fingers 17 having enlarged ends 17*a* which respectively engage in an annular retention groove 14*d* provided in the valve sleeve 14. In this position, a lower set of peripherally spaced collet arms 18, having enlarged portions 18*a*, are disposed with the enlarged portions 18*a* abutting the interior bore 10*a* of the tubular outer body 10, and hence the enlarged portions 18*a* project substantially inwardly relative to such bore for a purpose that will be hereinafter described.

After the insertion of the outer tubular body 10 into the described position relative to the casing perforations 2*a*, an inner tubular body 40 is inserted within such outer body. Inner tubular body 40 comprises a sleeve portion 41 which is suitably connected at its upper end to a tubing string and thus defines a relatively large area annular fluid passage 42 between the exterior of inner body 40 and the interior bore of the outer body 10. The lower end of the sleeve 41 of the inner tubular body 40 has a locator sub 45 threadedly secured thereto as by threads 41*a*. Locator sub 45 has a downwardly facing inclined locating surface 45*a* which engages the upwardly facing inclined surface 12*a* of the lowermost sleeve portion 12 of the outer tubular body 10. This assures the proper vertical location of the inner tubular body 40 with respect to the outer tubular body 10. Locator sub 45 also includes an annular seal element 46 which sealingly engages the internal bore surface 12*b* of the lower sleeve element 12 and is secured to the bottom end of locator sub 45 by an internally threaded sleeve 47. Thus the bore of inner tubular body 40 and its connected tubing string is effectively connected to the lower portions of the bore of the outer tubular body 10 and also to the bore of the casing 2 to provide a return path for the wash fluid.

The locating surface 45*a* performs an additional function in that as it moves downwardly into the tubular outer body 10, it engages the enlarged lower collet finger portions 18*a* and pushes the valve 16 downwardly to its sealed position illustrated in FIGS. 1A–1C, where it is retained by the engagement of the enlarged lower collet portions 18*a* in an annular groove 14*e* provided in the valve sleeve 14. In this position, it will be noted that the enlarged portions 17*a* of the upwardly extending collet fingers 17 are now positioned in an inwardly projecting position relative to the bore 10*a* of the outer tubular body member 10 for a purpose that will be later described.

Washing operations may then be conducted. As is the practice, the casing annulus is sealed by a conventional annulus valve (not shown) to prevent upward flow of wash fluid through the casing annulus. Washing fluids of conventional composition are supplied to the annulus 42 at pressures on the order of 500–900 psi and flow rates from 1 to 4 bpm. Those skilled in the art will recognize that the specific pressures and flow rates will be adjusted in accordance with the diameter of the casing, the number of perforations to be cleaned at a single setting of the wash tool and the formation pressure. The washing fluid passes freely down through the relatively large fluid passage area defined by the annulus conduit 42 and thence radially outwardly through the wash ports 11*a*, thence through the perforations 2*a*, removing any sand or particulates, and thence into the channels (not shown) in the production formation that are in communication with the casing perforations 2*a*. From this point, the sand laden washing fluid percolates downwardly around the exterior of the wall casing 2, and enters the interior of the casing 2 at its bottom (or through lower perforations) and passes freely upwardly through the bore 2*b* of casing 2, the bore of outer tubular member 10 and thence into the bore 40*a* of inner tubular member 40.

The fluid passage area of inner tubular member 40 is substantially smaller than that of the annulus 42 so that the flow rate of the sand laden washing fluid upwardly through the inner body member 40 is maintained at a sufficiently high level to insure that the sand is not dropped from the washing fluid during its passage to the wellhead, even though the well deviates substantially from the vertical.

When it is desired to retrieve the wash tool 1, or to effect its movement to another set of perforations, the inner tubular body 40 is moved upward relative to the outer tubular body 10 so as to bring an upwardly facing inclined shoulder 45*b* on the locator sub 45 into engagement with the inwardly projecting upper collet ends 17*a*. The valve 16 is thus moved with the inner body portion 40 to the position shown in FIG. 2, wherein the enlarged ends 17*a* of the upper collet arms 17 are engaged in the groove 14 of the valve sleeve 14. This, of course effects the movement of the solid central portion of the valve 16 to its open position relative to the bypass ports 14*a*.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

We claim:

1. The method of washing casing perforations and connected formation channels of a subterranean well comprising the steps of:

(a) inserting an outer tubular body into the well on a tubing string, said outer tubular body having radial ports alignable with a selected set of casing perforations, an open bottom communicable with the casing bore, annular sealing elements engaging the well casing above and below the said radial ports, and a radial bypass port disposed above said annular sealing elements;

(b) sealing the annulus between said outer tubular body and the casing above all casing perforations;

(c) inserting an inner tubular body having an open bottom bore within the outer tubular body on a second tubular string, a continuous annular passage thereby being defined between said outer and inner tubular bodies and said outer and inner tubing strings, the bore area of said inner tubular body being substantially less than the area of the annular passage;

(d) effecting a seal between the bottom end of said inner tubular body and the bore of said outer body at a position axially below said radial ports;

(e) circulating washing fluid downwardly through said annular passage, thence outwardly through said radial ports and through said casing perforations and said formation channels, thence around the exterior of the casing, and thence upwardly through the casing bore and the interconnected bore of the inner tubular member and its tubing string to the surface of the well; and (f) maintaining said port open during step (a), and closing said bypass port during step (c).

2. The method of claim 1 wherein said outer tubular body has radial bypass ports disposed above said annular sealing element and having an axially slidable valve positioned above said bypass ports during step (a), plus the step of moving said axially slidable valve downwardly to a closed position during the insertion of the inner tubular body in step (c).

3. The method of claim 2 plus the step of withdrawing the inner and outer tubular bodies from the well, the inner body being moved in advance of said outer tubular body to shift said axially slidable valve upwardly to its open position above said bypass ports.

* * * * *